United States Patent [19]

Reifers et al.

[11] 4,083,670

[45] Apr. 11, 1978

[54] APPARATUS FOR MAKING HIGH STRENGTH OPEN BOTTOM PACKAGING TRAY

[75] Inventors: Richard F. Reifers, New Canaan, Conn.; Henry A. Lord, Cape Elizabeth, Me.

[73] Assignee: Diamond International Corporation, New York, N.Y.

[21] Appl. No.: 769,989

[22] Filed: Feb. 18, 1977

Related U.S. Application Data

[60] Continuation of Ser. No. 568,784, Apr. 17, 1975, abandoned, which is a division of Ser. No. 481,850, Jun. 21, 1974, Pat. No. 3,894,679.

[51] Int. Cl.[2] ..... B29C 17/00; B29J 1/00

[52] U.S. Cl. ..... 425/398; 425/405 H; 425/358

[58] Field of Search ..... 425/385, 387.1, 388, 425/395, 405 R, 405 H, DIG. 44, 398

[56] References Cited

U.S. PATENT DOCUMENTS

| | | | |
|---|---|---|---|
| 3,348,265 | 10/1967 | King et al. | 425/405 R X |
| 3,372,436 | 3/1968 | Davis | 425/DIG. 44 |
| 3,594,877 | 7/1971 | Suda et al. | 425/440 X |
| 3,843,303 | 10/1974 | Medney | 425/396 X |

*Primary Examiner*—J. Howard Flint, Jr.
*Attorney, Agent, or Firm*—Karl W. Flocks

[57] ABSTRACT

A tray of molded pulp or the like for packaging meat, poultry or fish in conjunction with an overwrap transparent film and the method and apparatus for making the tray. The tray bottom is formed of a plurality of generally vertical ribs joining or intersecting in two directions and defining open windows therebetween, the height of each rib being on the order of several times the thickness of the remainder of the tray, the side and end walls having double sloped portions, and the total volume of the ribs being approximately equal to the volume of a bottom of an imperforate bottom tray of the same size. The method of making a tray including the steps of (a) taking a wet preform of molded pulp or the like formed in an open bottom construction with a plurality of inverted V or U-shaped ribs joining or intersecting in two directions and defining open windows therebetween and pressing the side walls of the V or U-shaped ribs together to impart to said ribs the form of generally vertical ribs with parallel side wall portions, and (b) drying the tray under controlled conditions to final form for storage or shipment. The apparatus for making a tray comprising a male forming die member including a plurality of rib grooves joining or intersecting in two directions into which a wet preform of molded pulp or the like may be transferred; a stuffing element for effecting initial seating of the rib members of the wet preform within the rib grooves; and female press die member with a plurality of insert plugs for pressing the ribs of the preform into the rib grooves of the male die member into fully seated relationship whereby final shape of the tray is imparted to the preform.

8 Claims, 17 Drawing Figures

APPARATUS FOR MAKING HIGH STRENGTH OPEN BOTTOM PACKAGING TRAY

This is a continuation application of applicants' pending Ser. No. 568,784, filed Apr. 17, 1975, which is now abandoned, but was a divisional Application of applicants' then pending application Ser. No. 481,850, filed June 21, 1974, and now U.S. Pat. No. 3,894,679.

FIELD OF THE INVENTION

The present invention relates to an apparatus for producing an open bottom food container and, more particularly, to a food container for use for the packaging of fresh meat, poultry and fish in conjunction with a transparent overwrap film, and where the bottom wall is replaced with a plurality of open windows defined by structural beams; and the resultant high strength package so produced. The present invention aditionally relates to the apparatus by which such a container is made.

BACKGROUND

Molded wood or paper pulp food trays have served the food packaging industry well for many years for the packaging of fresh meat, fish and poultry. Such trays have the advantage, besides low price and low cost to the consumer, of being clean, sturdy and safe; of being biodegradable so as to minimize the solids pollution problem; of being capable of assimilating the free liquid juices which exude from fresh meat, fish and poultry; of being air and vapor permeable so as to maintain color and freshness of meat and permit passage of liquid vapors. Nevertheless, in spite of the many advantages of such molded wood pulp trays, certain locales have effectively outlawed their usage by the requirement that a very high percentage of the food packaged therein be visible to the consumer and since wood pulp is normally opaque, such trays have not met this legal requirement.

Consequently, in such locales the only packaging trays utilizable in view of such laws are clear plastic trays. These clear plastic trays have many defects, some shared with foam plastic trays, including reduced strength, increased usage cost because of lack of important functional features like blood control that results in higher rewraps and/or downgrading of meat; such trays have sharp edges which tend to cut the packaging film and/or hands. These trays collect liquid exudants in puddles from the fresh meat, fish and poultry packaged therein, thereby not only causing discoloration of the packaged product, but also serving as a bacterial breeding ground and further serving to opacify the package itself and provide distortion in the remaining transparent areas thereby contributing to the very problem which such trays were designed to overcome; blood that goes under the tray acts to release the sealed film causing soiled hands, soiled check-out counters, leaking packages, etc. In addition, the conventional plastic trays, being formed of non-breathable material, inhibit oxygen migration to the meat at the bottom of the tray; this causes further discoloration of the meat and it is well known that fresh red meat in plastic trays deteriorates on the bottom first.

Another defect of the clear plastic trays involves their transmission of light along the plane of the tray walls, i.e., a light pipe or fiber optic effect; this causes further discoloration of the bottom of the meat. Light transmitted through clear plastic trays has a negative effect on fresh meat quality as it causes relatively rapid discoloration when compared with the effect of natural or artificial light on meat packaged in otherwise similar conditions. Because of the light pipe effect, meat packaged in clear plastic has its bottom exposed to light constantly even when the tray rests on an opaque object such as the bottom of the meat cooler or an underlying package or between two packages.

SUMMARY

It is, accordingly, an object of the present invention to overcome the defects of the prior art.

It is another object of the present invention to provide an apparatus for producing a molded, nestable tray, preferably of molded wood pulp or the like, for the packaging of fresh meat, fish and poultry which, in spite of being made of generally opaque or translucent material, provides a superior quality of visibility of the packaged product.

It is another object of the present invention to provide for the clean, safe and effective packaging of meats, fish and poultry.

It is another object of the present invention to provide a meat tray which, although being primarily open on the bottom is sufficiently strong so as to facilitate the handling of meat which tends to be floppy.

It is another object of the present invention to provide an apparatus for producing a meat packaging tray which is not only effective but which is inexpensive.

It is another object of the present invention to provide an apparatus for producing a meat packaging tray which provides maximum visibility of the meat packaged yet providing minimized effective support contact of the meat packaged in the bottom of the tray.

It is another object of the present invention to provide an apparatus for producing a meat packaging tray having improved fresh meat quality maintenance and superior visibility which are properties enhanced by the absence of visibility distorting and breathability inhibiting accumulations of free liquids, the tray tending to inhibit the exuding of juices by the meat but accepting any liquid which is exuded, in a controlled manner.

It is a major object of the present invention to provide a high visibility meat tray having an open multiple window bottom which has increased, rather than decreased, strength even when overwrapped with stretchable, transparent plastic film which acts to compress and sometimes collapse a conventional tray; and which also has high beam strength.

It is another object of the present invention to provide an apparatus for producing a meat packaging tray which provides visibility by providing a minimum surface contact of the meat.

It is another object of the present invention to provide an apparatus for producing an improved meat storage packaging tray in which the bottom side of the meat is subjected to increased oxygen transmission and in which the bottom of the meat is not subject to rapid deterioration as in imperforate plastic trays.

It is another object of the present invention to provide an apparatus for producing a packaging tray in which the bottom side of the meat is subjected to improved oxygen availability to best maintain freshness and color.

It is another object of the present invention to provide an apparatus for producing packaging which will maintain packaged meat in a moist but not wet condition.

It is another object of the present invention to teach the production of packaging for eliminating meat contact with a non-breathing tray structure and provide an oxygen permeable, see-thru structure that keeps meat from touching the film windows on the bottom of the tray.

It is another object of the present invention to teach how to obviate the necessity of utilizing clear plastic food trays which often provide poor, distorted and/or obstructed visibility which results when the meat bleeds in clear polystyrene plastic trays since such material is not oxygen permeable and thus tends to discolor the meat, and which also transmits light to the bottom of the tray because of fiber optic effect thereby adding to the discoloration problem, as the clear plastic also collects exuded liquid in pools thereby adding to visibility distortion and forming bacterial breeding grounds, and causing nutrient loss of exposed surfaces.

It is another object of the present invention to provide an apparatus and the use thereof for an improved tray with an open bottom, defined by intersecting, generally vertical support ribs, from molded pulp or the like.

It is another object of the present invention to provide a new and improved finishing apparatus in which a wet preform of molded pulp or the like may be given final form to produce a tray with an open bottom defined by a plurality of generally vertical ribs intersecting in at least two directions or any other shape of any kind, that provides structure, like hexagons, circles, etc.

These and other objects and the nature and advantages of the instant invention will be more apparent from the following description.

Meat packaging trays have evolved substantially over the years. The earlier trays had essentially straight side walls and a flat peripheral lip, and these served the trade successfully for many years. However, as the nature of transparent plastic wrap film changed and non-elastic and non-shrink cellophane was replaced with more elastic thermoplastic or stretch overwrap films, the tray in accordance with Reifers U.S. Pat. No. 3,185,371 was developed improving the tray performance. In more recent years there has been a strong consumer desire for greater visibility of fresh meat packaged in trays.

A recent approach to provide visibility through the bottom wall of the tray, corresponding to the invention of the Reifers et al application Ser. No. 280,172, filed Aug. 14, 1972, now U.S. Pat. No. 3,764,057 and owned by assignee of the instant application uses a plurality of meeting or intersecting, inverted V or U cross-section shaped ribs extending across the bottom of the tray. This construction provides improved visibility with reduced meat contact, and the inverted V-shaped ribs provide for a reinforced structure. The construction exemplified in the Reifers et al application is, in many respects, a successful approach to the problem, and the present invention constitutes an improvement on this basic construction.

An improved tray construction and method and apparatus of producing such an improvement wherein the rib structure will be vertical and preferably without bottom flange or web to provide maximum visibility and precise control of rib depth for each and every tray are disclosed herein.

As with the trays exemplified in the copending application mentioned above, there may be substantial variability in the size and shape of the ribs. In general, the height of the ribs is dependent on the size of the window openings therebetween, so that the smaller the opening and the greater the number of ribs for any given tray bottom area, the smaller the ribs need be in height, both for sufficient strength and for packaged product maintenance. In this latter regard, the packaged meat should be kept off the overwrap film on the bottom of the tray. In general, many small ribs tend to reduce visibility so that the preferred minimum rib height should be on the order of about 7/64 inch to $\frac{1}{4}$ inch with openings therebetween from $\frac{3}{4}$ inch to 1 inch depending upon shape of opening. The ribs have a width of only about $\frac{1}{8}$ inch to about 3/16 inch.

In general, it will be understood that the higher the ribs, the greater will be the strength. In general, the total volume of wood pulp forming the ribs, before reshaping thereof, at the bottom of the tray and defining the open windows therebetween, is about 90–100% of the volume and weight of the same area of a bottom of a conventional tray of the same size, such as that shown in the Reifers U.S. Pat. No. 3,185,371 which is assigned to assignee of the instant application; in the final product the rib volume is less than 90%, the preformed ribs having been compressed and densified during reshaping.

Fresh meat packaged in conjunction with the tray of the present invention, when formed of molded wood pulp, stays fresh significantly longer than meat packaged in the so-called clear polystyrene trays. Over the normal holding time in the supermarket showcase, fresh meat packaged in accordance with the present invention has better blood retention, flavor retention, and better blood control resulting in substantial savings due to reductions in rewraps, less downgrading, hence less actual loss of the original money value of the meat. Also, by using trays as disclosed herein there is effected a reduced amount amount of meat that is actually thrown out because of its acquiring an unsalable appearance, odor, etc. Improvement also occurs in the appearance of meat packaged in accordance with the present disclosure compared with meat packaged in foam plastic trays. In general, the tray of the present disclosure provides improved oxygen transmission, moisture vapor and blood control under the meat, no fiber optic problem like clear polystyrene trays, all resulting in improved meat appearance with unequalled protection to the fresh appearance and the fresh odor of meat.

The improved characteristics of the package of the present disclosure are accomplished by the use of the high support beams of rib construction, which are themselves strong and which meet the end and side walls along a transition zone which maintains high side wall compression resistance. This rib connection with the side and end walls is accomplished by the use of walls which have been formed so as to be generally vertical. The high rib strength, when the tray is manufactured of wood pulp, is provided by rib side walls extending in generally vertically-pressed-together reinforcing relationship to better support vertical loads applied to rib structure of comparable weight, height and rib thickness. Further, improved visibility and appearance is provided in the tray according to the present disclosure.

The fundamental aspects of the tray in accordance with the present disclosure may be said to be: spaced beam members, the spacing being open between such beam members to allow for viewing the tray contents between each beam of relatively solid material. The section modulus of the beams is such that in combination with the end and side walls, the total strength equals or exceeds the beam strength of a tray of the same material of equal or slightly more weight with a flat imperforate solid bottom.

For a better understanding of the invention, a possible embodiment thereof will now be described with reference to the attached drawing, it being understood that such embodiment is intended as merely exemplary and in no way limitative.

DETAILED DESCRIPTION OF PREFERRED EMBODIMENT

Figure 1:
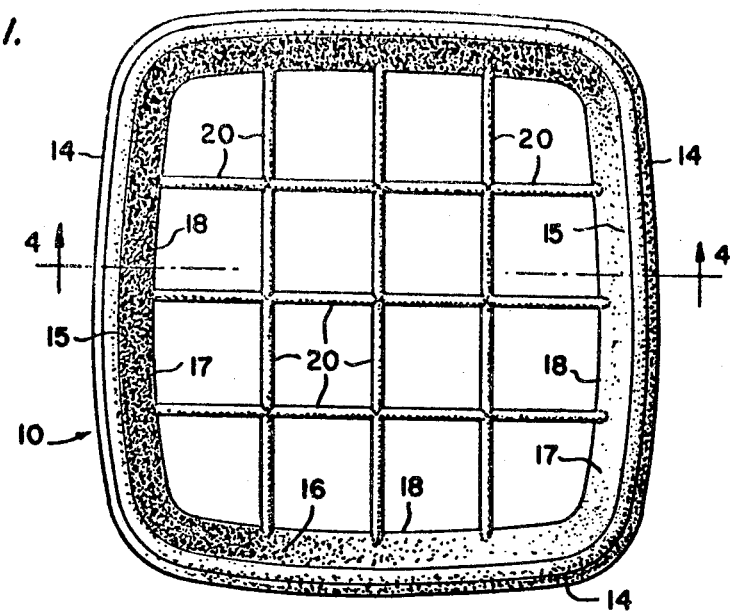
FIG. 1 is a top plan view of a preferred embodiment of a tray in accordance with the present disclosure.

Referring to FIGS. 1–4 of the drawings, it will be seen that a tray 10 is provided for the packaging of meat, fish or poultry in association with an overwrap film of transparent plastic material such as shrink or stretch plastic film, or heat-sealable cellophane. The tray 10 has four upwardly and outwardly inclined walls 16 and these are preferably bowed as described in Reifers U.S. Pat. No. 3,185,371. The adjacent side walls merge at rounded corners 12, and such side walls terminate at their upper end in a downwardly and outwardly extending peripheral lip 14; while any conventional peripheral lip may be used, the preferred lip corresponds to the special lip disclosed in copending application Ser. No. 280,172.

Instead of a flat bottom as is conventional, the tray 10 is provided with a plurality of marginal ribs 18 and inner ribs 20 which extend between the bottoms of the side walls 16. As is illustrated, the marginal ribs 18 extend in slightly arcuate marginal expanses and inner ribs 20 preferably extend in two different directions at right angles and are uniformly spaced to define therebetween windows of a more or less rectangular configuration. Of course, it will be understood that there may be provided variations in the configuration, spacing, height and arrangement of the ribs and of the windows, e.g. the ribs may intersect or meet at different angles so as to provide brick-work, diamond-shaped, window patterns, or the trays may be generally circular, hexagonal or other similarly shaped members with the vertical ribs thereof being of a shape similar to that of the tray member having such ribs. A construction in accordance with the present invention may also be made with the annular transition zone of Ser. No. 280,172.

Figure 2:
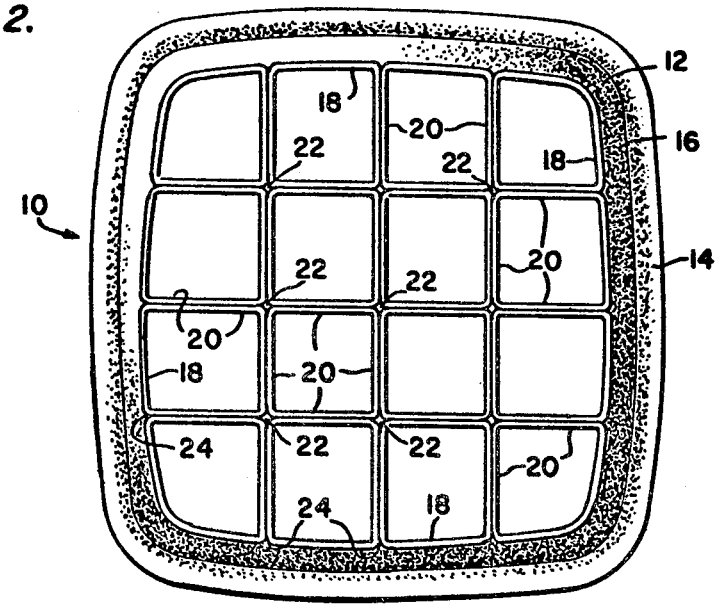
FIG. 2 is a bottom plan view of the tray of FIG. 1.
Figure 4:
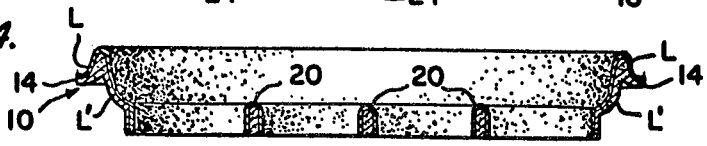
FIG. 4 is a section taken along line 4—4 of FIG. 1.

As best seen in FIG. 4, the ribs 20 form in cross-section a pair of vertically extending side wall portions in reinforcing contact with their apices forming the meat supporting surface, and it is clear from inspection that the apex of each rib is well rounded unlike the sharp ribs which might be present in hard plastic that might cut or otherwise damage the meat. As seen in FIG. 2, each inner rib 20 meets at each end thereof with three other inner ribs 20 in a recess 22. Each marginal rib 18, on the other hand, meets at each end thereof with another marginal rib 18 in a notch 24.

Figure 3:
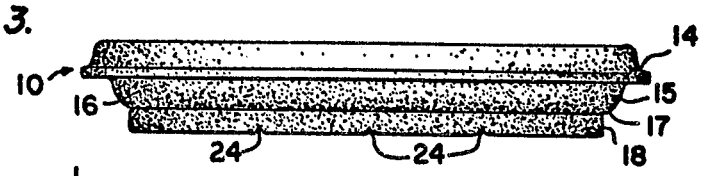
FIG. 3 is a front elevation of the tray of FIGS. 1 and 2.

The present disclosure also provides the feature in which the shape of the side walls 16, as best shown in FIGS. 3 and 4 are formed with a double slope to enhance the strength thereof. Thus, the upper part of each wall 16 has an upper straight portion 15, an intermediate curved portion 17 and a lower straight portion 18. The curved portion 17, in the preferred embodiment, has a radius of curvature of 0.187 inch. Also, in the preferred embodiment, the upper portion 15 of the walls 16 is inclined from the vertical at an angle of 17°.

While the tray of the present invention is preferably molded of conventional wood or paper pulp stock which may be formed or preformed from a water slurry, it will be understood that other materials, including foam plastic or the like, may be used; the ribs may be made of harder paper stock, or such ribs may be specially pressed or otherwise treated. In a preferred embodiment, the wood pulp stock comprises about 3% urea-formaldehyde wet strength resin or about 1½% melamine-formaldehyde wet strength resin (both FDA approved) and, furthermore, has a large capacity to accept free liquids which have exuded from the "problem cuts" or "heavy bleeders", as they are known in the art; in this embodiment the bottom of the tray ribs may be specially treated with an inert, impervious water-resistant substance, e.g. wax or plastic such as polyethylene, while the upper portions of the ribs will accept this free liquid and expand to provide a softened cushion for the meat.

If desired, the rib tops may also be coated with the impervious substance, leaving the side rib surfaces and its center free to accept excess free liquids. Also, as best seen in FIG. 4, the tray 10 may be formed with an upper layer L of a certain grade of material, usually a higher grade, and a lower layer L′ of another grade of material.

Looking now at FIGS. 5–8, the preferred embodiment of the apparatus for producing the tray according to the present invention is seen to include a male finishing die member 100 upon whch a wet preform 10 of molded wood pulp or the like may be transferred and a pressing head or female die member 150. The pressing head or female die member 150 in operation presses the wet preform into the male die member 100 and thus imparts final form to the tray to be formed by the preform 10.

Figure 7:
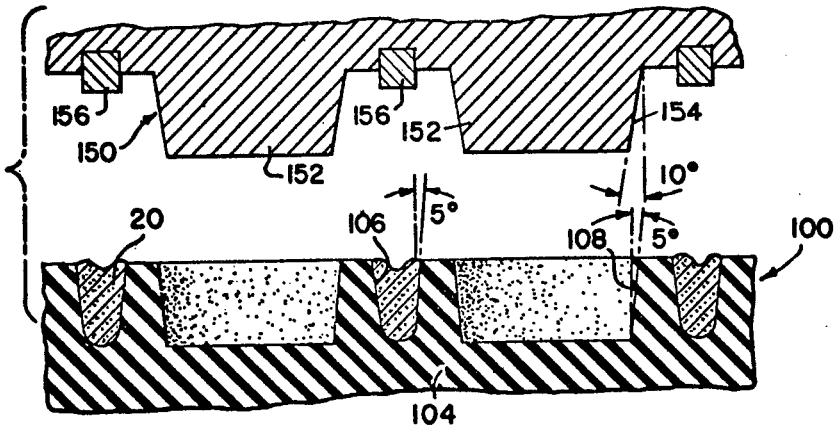
FIG. 7 is an enlarged fragmentary view of the apparatus in FIG. 6 together with a cooperating female pressing die member.
Figure 8:
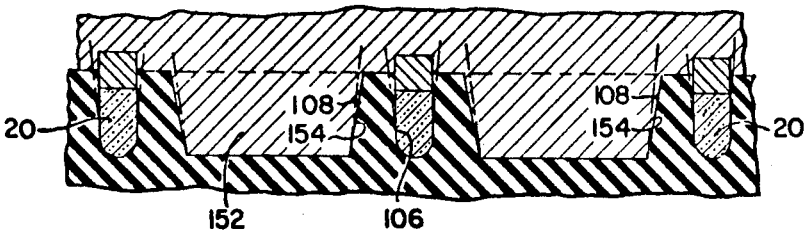
FIG. 8 shows the die members of FIG. 7 in the engaged pressing condition thereof.

A closer look at male die member 100 reveals that it comprises an aluminum core 102 with a receiving mold sub-assembly 104 of resiliently deformable material such as silicone rubber. The receiving mold sub-assembly 104 is provided with a plurality of rib grooves 106 and cavities 108. The side walls of the rib grooves 106 and the side walls of the cavities are inclined from the vertical at approximately 5° as best seen in FIG. 7.

The pressing head or female die member 150 preferably is of aluminum and comprises a plurality of plugs 152 and pressing bars 156. The side walls 154 of each plug 152 are inclined toward the center thereof from the vertical at approximately 10°.

Figure 5:
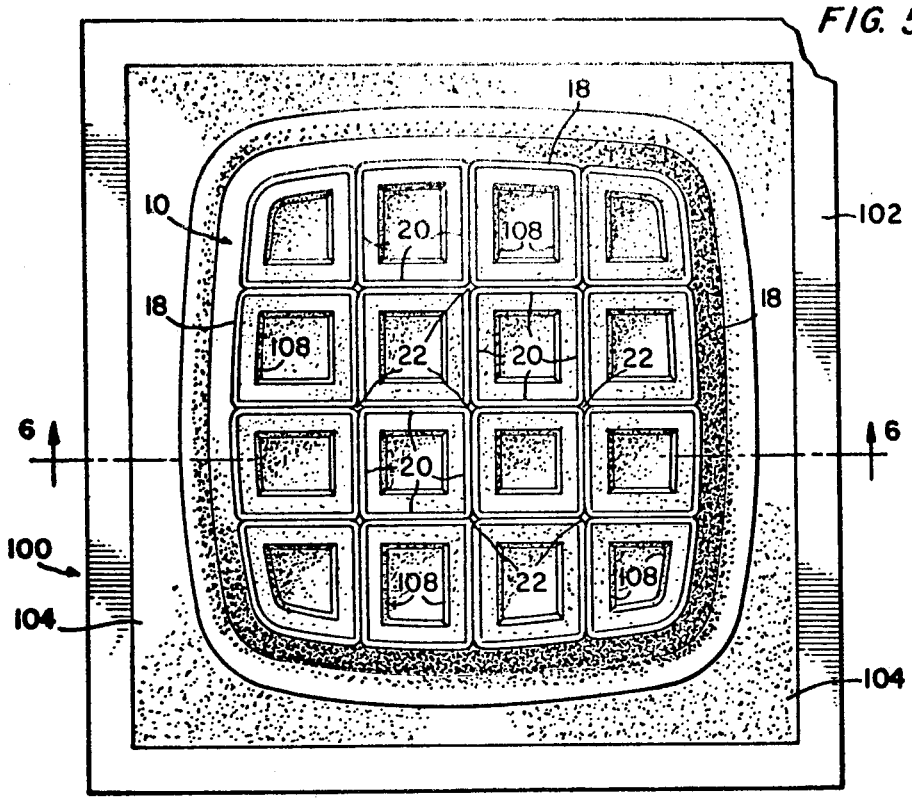
FIG. 5 is a top plan view of a male die member according to the present invention with a wet preform of molded pulp or the like disposed therein for a finishing operation.
Figure 6:
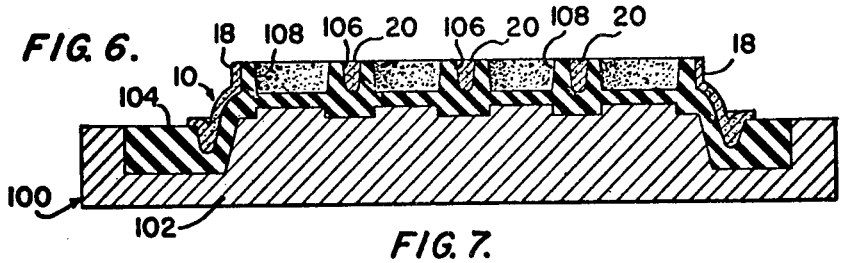
FIG. 6 is an elevational view taken along line 6—6 of FIG. 5.

From FIG. 5 it is clear that rib grooves 106 will be provided in an intersecting pattern in grid form upon which the ribs 20 of wet preform 10 may be transferred and received. The cavities 108 correspond generally in location to the open window space defined by the ribs 20 of the finished tray of FIG. 1. In operation, plugs 152 are in registration with cavities 108 and pressing bars 156, which correspond with rib grooves 106 formed between pairs of spaced apart, upstanding webs in grid-like arrangement, are in registration therewith. The pairs of spaced apart, upstanding webs forming rib grooves 106, as may be seen in FIGS. 5–8A, include adjacent sides which form rib grooves 106 and also remote sides, some of which together with remote sides of other upstanding webs form generally rectangular cavities 108.

Figure 14:
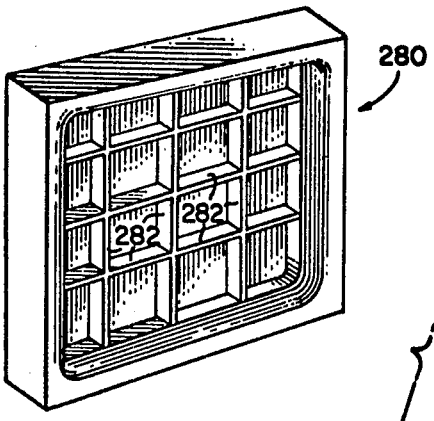
FIG. 14 is a view in perspective showing details of the bottom of a stuffing bar assembly.
Figure 15:
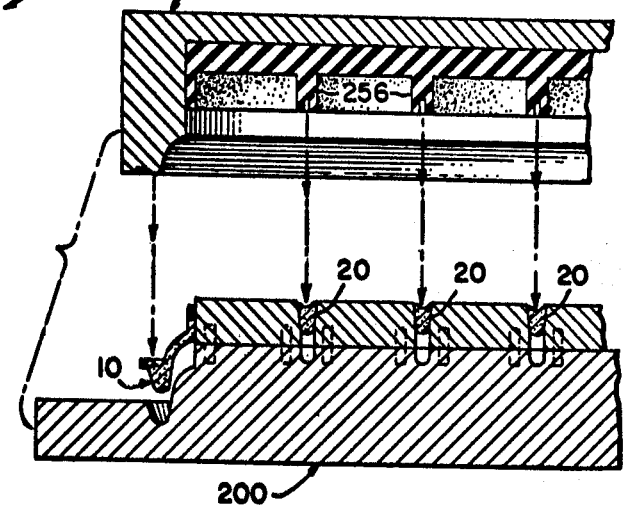
FIG. 15 is a fragmentary exploded elevational view in section of the male and female die members of FIGS. 9–12 prior to engagement thereof.
Figure 16:
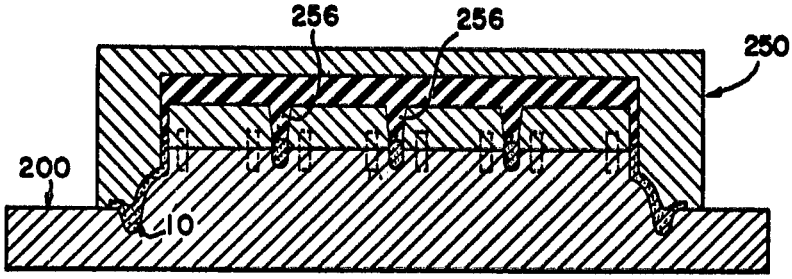
FIG. 16 is an elevational view in section of the die members of FIG. 15 in the engaged condition thereof.

In operation, a wet preform 10 of wood pulp for the tray to be made is transferred from a suction mold, for example, and deposited, bottom side up, over the receiving mold sub-assembly 104. The ribs of the preform as seen in FIG. 7 are generally V-shaped and as the rib grooves 106 are provided with inclined side walls, reception thereof by the grooves is facilitated. Preliminary entry or stuffing of the ribs of the preform may also be facilitated by use of a stuffing grid bar 280, as seen in FIG. 14. As pressing head 150 is lowered into the position illustrated in FIG. 8, the inclined side walls of rib grooves 106 will be compressed into vertical position, which thereupon reshapes the ribs 20 into vertically extending members. Compression of the inclined side walls of rib grooves 106, as clearly illustrated, is the result of outward transverse deformation of cavities 108 by entry of plugs 152 therein.

From the foregoing, it is clear that the method and apparatus described provides a tray with rib structures that are vertical and without bottom flanges, all with precise control of all dimensions including depth and thickness and configuration or rib structure, as well as improved surface finish and added strength due to compacting of fibers.

In the closed condition of the foregoing apparatus, heat may be applied to the closed dies so that the product may be form-dried or the product may be removed from the male die member and free-dried on an open conveyor chain, this latter preferably being with the screen side of the tray up.

Upon removing the pressing head 150 from engagement with the male die member 100, the silicone rubber receiving mold sub-assembly 104 will resume the form illustrated in FIG. 4, whereupon the tray 10 may be freely removed therefrom. The selection of material for the sub-assembly 104 is not to be limited to silicone rubber, but may be any yieldable material capable of withstanding drying temperatures and recovering the original form thereof.

An alternative form of the apparatus according to the present invention is illustrated in FIGS. 9–16. The alternative apparatus comprises a male receiving die member 200, a female pressing die member 250, and a grid stuffing bar assembly 280.

Male receiving die member 200, preferably is of aluminum and includes a plurality of rib grooves 206 with vertically extending side walls. Rib grooves 206, as is to be clearly understood, are to be of generally the same arrangement as those of die member 100 of the previous embodiment, that is, in intersecting grid arrangement. Extending upwardly from the upper extremity of vertical side wall of each groove 206 is an upwardly diverging passageway 216 which facilitates reception therein of the ribs 20 of the wet preform for the tray 10.

Female pressing die member 250 comprises a plurality of pressing bar elements 256 formed with normally vertical side walls and cut-out slots 258 formed between spaced apart webs at the lower ends thereof which allow inward displacement of material. Portions of the male pressing die member 250, which, in operation, engage with the female receiving member 200, are of silicone rubber or the like and thus may be resiliently deformed as required.

Grid stuffing bar assembly 280 comprises a plurality of vertically extending stuffing bar portions intersecting in at least two directions and adapted to be in registration with passageways 216 of male die member 200.

Female pressing die member 250 and grid stuffing bar assembly 280 may be mounted in a turret arrangement, whereby they may be selectively positioned for operation.

Figure 9:
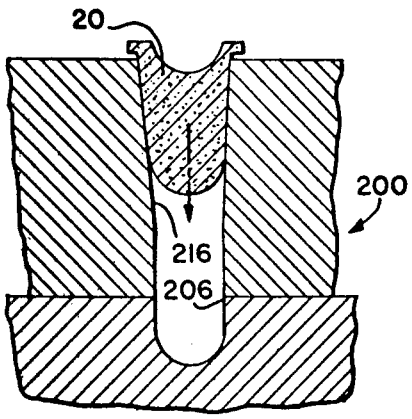
FIGS. 9–12 show enlarged fragmentary views in section of the die members of an alternative embodiment of the present invention according to the sequence of operation.
Figure 10:
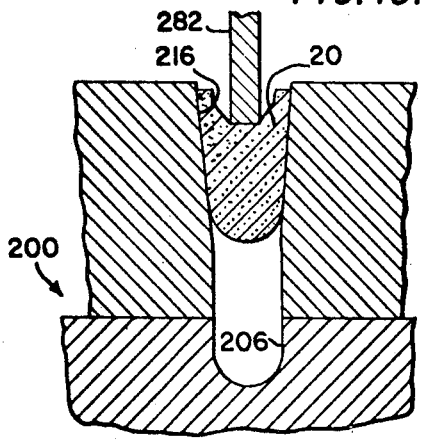
Figure 11:
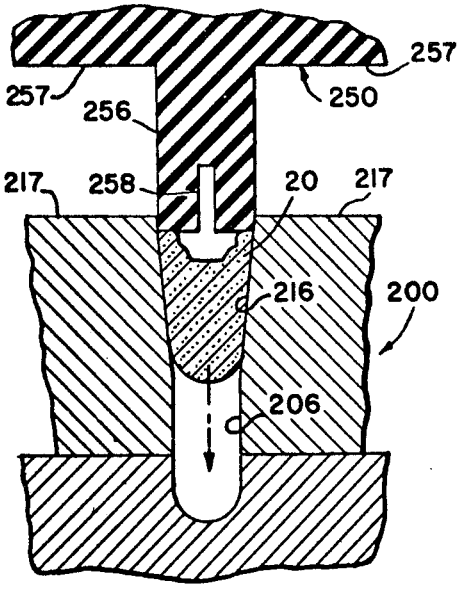
Figure 12:
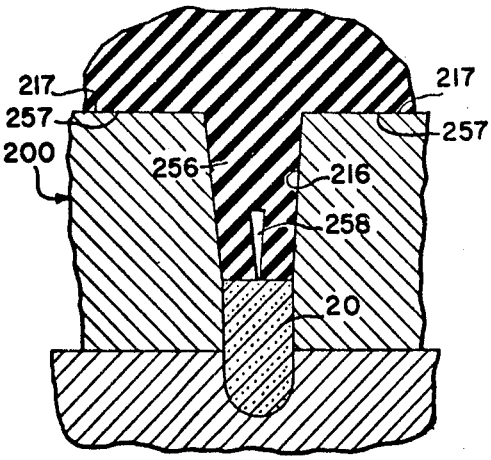
Figure 8A:
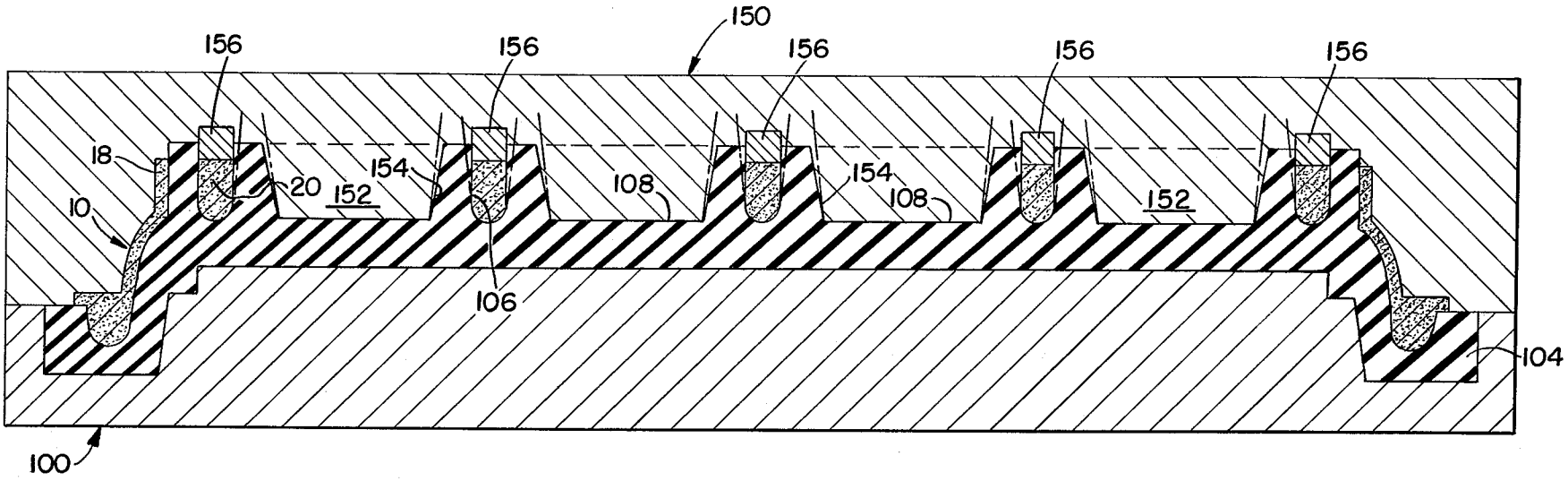
FIG. 8A is an elevational view in section of the die members of FIG. 8 in the engaged pressing condition, but with the die members in their entirety.
Figure 13:
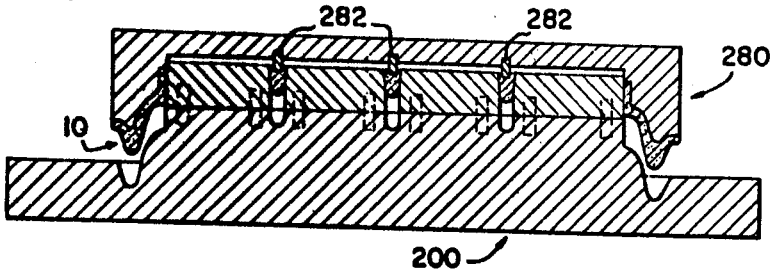
FIG. 13 shows an elevational view in section of the male die member of FIGS. 9–12 with a grid stuffing bar assembly engaged therewith.

In operation, a wet preform 10, as heretofore described, may be transferred from a suction mold, for example, and deposited, bottom side up, over the receiving die member 200, as seen in FIG. 9. The ribs 20 of the preform 10 may, as formed, be generally V-shaped in cross-section and include trailing overhanging portions to hinder free and full entry thereof into passageways 216. Use of grid stuffing bar assembly 280 is thus restored to, whereby ribs 20 are urged into passageways 216 under the influence of stuffing bar assembly 280 as seen in FIG. 10. Upon entry of ribs 20 into passageways 216, stuffing bar assembly 280 is withdrawn and female pressing die member is brought into registration with male receiving die member 200, as seen in FIG. 11, and lowered thereinto, as seen in FIG. 12.

Passageways 216 initially, that is at the upper end thereof, must be and are of sufficient size to freely admit entry of pressing bar elements 256. Female pressing die member 250 is of resiliently deformable material such as silicone rubber, and because of this the pressing bar elements 256 will be yieldably compressed by the tapered passageways 216 to form to the contour thereof as seen in FIG. 12. The length of the pressing bar elements, as seen in FIG. 12, is such that the rib elements 20 will be caused to be fully seated in the rib grooves 206 and be reshaped so as to have vertically extending side walls. Also, the trailing portions of the rib elements 20 of the preform as seen in FIG. 11 will be flattened when female pressing die member 250 reaches the fully engaged relationship with male receiving die member 200. Depth of penetration of pressing bar elements 256 is limited by horizontally extending face portions 257 which extend from opposite sides of the upper ends of pressing bar elements 256. Thus, penetration of pressing bar elements 256 into passageways 216 is terminated upon contact of the horizontally extending face portions 257 of female pressing die member 250 with the upper outer horizontal surface 217 of male die member 200. In view of the foregoing, depth or height of ribs 20 may be controlled by the length of pressing bar elements 256 and the cooperating rib grooves 206. When the female pressing die member 250 is withdrawn from the engaged position, pressing bar elements 256 will recover the expanded free form thereof due to the resilience of the material, which, as previously mentioned, may be of silicone rubber.

In the engaged pressing condition of member 250 with male member 200, heat may be supplied thereto to form-dry the tray or, alternatively, female die member 250 may be withdrawn and the tray 10 as shaped may be withdrawn from male die member 200 by any known means and transferred to be dried, for example, on freedrying apparatus.

If desired, the tray of the present disclosure may be formed of other, equivalent materials, the structural advantages of the tray deriving from its geometry. For example, the tray may be formed of plastic foam, such as structural cellular polystyrene foam comprising on the order of 70% void space, or porous polyolefin material or other open cell plastic, or a biodegradable plastic such as biodegradable foam polystyrene. If formed of materials having different strength characteristics, various changes in the configuration may be necessary and, depending on the material, certain advantages may be absent.

It will be understood that visibility through the bottom of the tray to the bottom surface of the meat is very great, on the order of at least 80% or more, and that there is a minimum surface contact of the meat on the soft rounded apices of the generally vertically extending ribs.

The tray of the present invention has many advantages, a number of which have been delineated above. In brief, however, it may be noted:

(a) Visibility — Both sides of fresh or processed meat, fish or poultry may be viewed, providing up to 90% view or more of contents with at least 80% or more of the bottom of the contents being visible. This actually results in improved visibility when compared to clear plastic trays, some of which introduce an adder layer of thick plastic sheet in each window area and do not control juices of fresh meat, fish or poultry which distort, mislead, and impair vision where they exist. Because the ribs of the present disclosure are generally vertical, they provide improved visibility over trays of this general type in which the ribs are V-shaped as the spaced-apart free edges of the V-shaped ribs preclude maximum visibility.

(b) Strength — Added beam of structural members across bottom adds stiffening. Tray easily resists all types of normal handling: (1) The tray has improved strength to resist handling during wrapping; compression of film on the inward side wall is the main force which tends to cause side wall deformation or collapse, but the present tray resists such deformation or collapse; and improved capacity in supporting vertical loads. (2) The tray resists damage from handling in the store and by consumer at home; insufficient beam strength of package for weight of contents may tend to deform or break some packages when lifted, but the tray of the present disclosure tends to resist such deformation or breakage.

(c) Breathability — For freshness and bloom protection of fresh meat, the open meat suspending structure promotes oxygen transfer as does the absence of free liquid pools which, in other packages, clog the pores of the overwrap film. This maintains better meat color and provides for maintenance of meat blood and quality over the extended period for store sale to home storage. In addition, anaerobic bacteria, such as slime bacteria, are controlled or destroyed with the high oxygen transmission provided.

(d) Juice Control — The ribbed tray suspends the entire bottom of the meat in a moisture saturated atmosphere, which is desirable for meat quality preservation. The wet or bloody surface of the fresh meat creates the moisture laden atmosphere to protect the meat freshness. If the meat should weep, the bloody liquid is accepted by the porous grid window structure. This controlled acceptance of free liquids enhances appearance, maintains near perfect visibility and prolongs the freshness and bloom of the meat. Elimination of flange or web portions at the bottom of the ribs also improves juice control and visibility. The actual contact of the meat with the tray surface is less than any imperforate tray structure ever known in commercial use. With proper refrigeration of the meat, this minimal contact of the meat with the tray together with the maintenance of the moisture saturated atmosphere inhibits the exuding of liquids and insures that the meat retains its moist surface and juicy character but without forming puddles or pools of liquid.

(e) Nestability — Trays nest closely for economical storage and shipping. The bottom itself determines the stacking interval and gives good denesting as well as prevention of jammed trays. The uniform rib support of the stacked tray bottoms allows ram stacking under pressure to reduce the stacking height of the trays. In addition to the obvious advantages of space saving provided, such ram stacking also aids denesting, since each tray tends to separate, due to the internal compressive spring back produced by pressure stacking of a naturally resilient material in the bottom ribs.

(f) Refrigeration — Beam bottom construction holds meats suspended, providing improved circulation of moisture saturated air for oxygenation of the meat.

Unlike the so-called clear polystyrene tray, the construction of the present disclosure with its open windows serves to effectively control the free flowing of bloody liquid.

Even a small amount of blood in the clear polystyrene tray creates an immediate problem in the area covered with blood because of distortion or complete obstruction of visibility in the affected area, and additionally exposes the meat surface to a pool of bloody liquid that provides a broth for bacterial action, often causing slime build-up and causing shorter shelf life in the store and in the home refrigerator. By way of contrast, the trays of the present disclosure with the multiple open window features maintain the advantages of control of exuding liquid, primarily by maintaining a saturated atmosphere about the meat but also by controlled acceptance while at the same time taking advantage of this control to maintain excellent visibility in the windows that are breathable, maintaining great effectiveness of the transparent film over the entire surface of the package, protecting it to the maximum freshness and minimum bacterial action.

The trays of the present disclosure also have no problem of cutting film like the clear plastic trays because the film is protected by the soft edges of the pulp tray. The meat contained in the clear polystyrene tray is exposed to bacteria and other contamination when the film has been cut by the sharp edges of the tray.

After extended storage the meat in the clear polystyrene trays nearly always discolors on the bottom first because of the destructive effects of the nonbreathing, light transmitting, clear styrene material. On the other hand, the trays of the present disclosure work to protect the meat freshness so perfectly that the bottom of the meat most always retains its meat freshness longer than the top of the meat under conditions of extended storage.

It will be understood that the invention is not limited to the embodiment disclosed which is offered illustratively and that modifications may be made without departing from the invention. For example, both the male and female pressing dies may be formed of nonelastic material such as metal, in which case a small taper, on the order of about 5° from the vertical, may be necessary and will occur in the ribs of the final product.

We claim:

1. A finishing apparatus for imparting final form to an open bottom tray of molded pulp or the like with vertically extending intersecting ribs comprising male die means including a resiliently deformable member for reception of a preform of molded pulp and a rigid core member underlying said deformable member and extending around peripheral edges of said deformable member, and female pressing die means including a plurality of rigid bar elements for pressing a preform into said male die means whereby final form is imparted to the preform, the deformable member including a plurality of pairs of spaced apart, upstanding webs forming rib grooves between adjacent sides, said rib grooves intersecting in at least two directions and having diverging side portions which facilitate entry of a preform and said bar elements into said rib grooves of said male die means, said pairs of groove forming webs having remote sides at least one of which forms a cavity with remote sides of others of said groove forming webs, said pressing bar elements of said female pressing die means intersecting in at least two directions corresponding to said rib grooves of said male die means whereby said pressing bar elements penetrate into said rib grooves to cooperatively give final form to the generally vertically extending ribs of the tray to be formed, said female die means also including downwardly extending plug portions which during engagement of said male and female die means enter into engagement with said cavities formed by said webs in said male die in direct lateral contact therewith and thus subject said rib forming webs and preform received in said rib grooves to lateral compression, said deformable member being thus deformed having sufficient resiliency to recover the free form thereof upon disengagement of said male and female die means whereby an open bottom tray given final form in said apparatus may be readily removed therefrom.

2. The apparatus according to claim 1, wherein said resiliently deformable member is of a silicone rubber or like material capable of undergoing deformation and recovery.

3. The apparatus according to claim 1, wherein some of said rib grooves of said deformable member intersect others of said rib grooves in at least two directions to form a grid arrangement, said rib grooves being generally V-shaped with side wall portions thereof being inclined approximately 5° from the vertical.

4. The apparatus according to claim 3, wherein each of said rib grooves along with three other rib grooves form a generally rectangular cavity with side wall portions inclined approximately 5° from the vertical in the direction toward side wall portions of an adjacent rib groove.

5. The apparatus according to claim 1, wherein said plug portions include side walls inclined approximately 10° from the vertical, each of said plug portions being so dimensioned that initial free entry thereof into one of said cavities of said receiving mold subassembly is facilitated, but upon penetration of each of said plug portions into the cavity associated therewith the side walls of said plug portions displace the surrounding portions of said deformable member whereby inclined side wall portions of surrounding rib grooves are forced to assume a vertical attitude thereby imparting vertical shape to rib elements of the preform received therein.

6. The apparatus according to claim 5, wherein pressing bar elements are of sufficient width to limit inward displacement of side wall portions of said rib grooves by said plugs to a vertical attitude and of sufficient depth to compress rib elements of a preform disposed in said rib grooves in a downward direction whereby vertical ribs of controlled height and thickness are formed in an open bottom tray of molded pulp or the like.

7. The apparatus according to claim 5, wherein side wall portions of said rib grooves are of silicone rubber material and will recover their inclined attitude upon disengagement of said male and female die means to facilitate removal of the tray.

8. The apparatus according to claim 1 wherein said plug portions are spaced-apart horizontally from said pressing bar elements by a generally flat surface between each of said plug portions and one of said pressing bar elements, said groove forming webs each include an upper edge, and wherein each of said upper edges of said groove forming webs are in contact with said generally flat surface between said plug portions and said pressing bar elements during engagement of said male and female die means.

* * * * *